US007219813B2

(12) United States Patent
Weiss et al.

(10) Patent No.: US 7,219,813 B2
(45) Date of Patent: May 22, 2007

(54) BEVERAGE CONTAINER FOR HOLDING A COMPACT DISC

(75) Inventors: Volker Weiss, Berlin (DE); Juergen Gaspar, Lonsee (DE)

(73) Assignee: DOCdata Germany Berlin Optical Disc GmbH, Berlin (DE)

( * ) Notice: Subject to any disclaimer, the term of this patent is extended or adjusted under 35 U.S.C. 154(b) by 191 days.

(21) Appl. No.: 10/748,438

(22) Filed: Dec. 30, 2003

(65) Prior Publication Data

US 2005/0082177 A1 Apr. 21, 2005

(30) Foreign Application Priority Data

Oct. 15, 2003 (DE) ..... 103 49 192
Nov. 3, 2003 (DE) ..... 103 51 557

(51) Int. Cl.
*B65D 1/18* (2006.01)
*B65D 83/00* (2006.01)
*A47G 19/22* (2006.01)

(52) U.S. Cl. ..... 220/705; 220/521; 220/522; 220/256.1; 220/255; 220/713; 206/217; 206/308.1

(58) Field of Classification Search ..... 220/521, 220/522, 709, 255, 256.1, 253, 212, 705, 220/713; 215/227, 387; 206/217, 308.1, 206/493

See application file for complete search history.

(56) References Cited

U.S. PATENT DOCUMENTS 4,074,827 A 2/1978 Labe, III ..... 220/23
4,441,624 A * 4/1984 Sokolowski ..... 220/254.1
6,070,752 A 6/2000 Nava et al. ..... 220/521
6,305,571 B1 * 10/2001 Chu ..... 220/719
6,481,573 B2 * 11/2002 Gordon et al. ..... 206/232
6,675,960 B2 * 1/2004 Innis ..... 206/308.1
2004/0031797 A1 * 2/2004 Farnsworth et al. ..... 220/212
2005/0205586 A1 * 9/2005 Weiss et al. ..... 220/705

FOREIGN PATENT DOCUMENTS

WO WO 02/068275 A2 9/2002

* cited by examiner

*Primary Examiner*—Robin A. Hylton
(74) *Attorney, Agent, or Firm*—Meyer & Williams PC; Karin L. Williams, Esq.; Keum J. Park, Esq.

(57) ABSTRACT

A beverage container (1) includes a cup-type compartment (2) having an opening (3) and a cover (4) to be placed on the opening (3), the cover (4) having an inner component (5) and an outer component (6) detachably connected to the inner component (5), between the inner component (5) and the outer component (6) connected to the inner component (5) a cavity (7) being formed for receiving at least one object (8), the cavity (7) includes two main surfaces (9, 10) being parallel to one another. It is characterized by that the two main surfaces (9, 10) of the cavity (7) are at an angle of $0° < \alpha < 90°$ to an opening plane (11) formed by the opening (3).

16 Claims, 2 Drawing Sheets

BEVERAGE CONTAINER FOR HOLDING A COMPACT DISC

FIELD OF THE INVENTION

Figure 1:
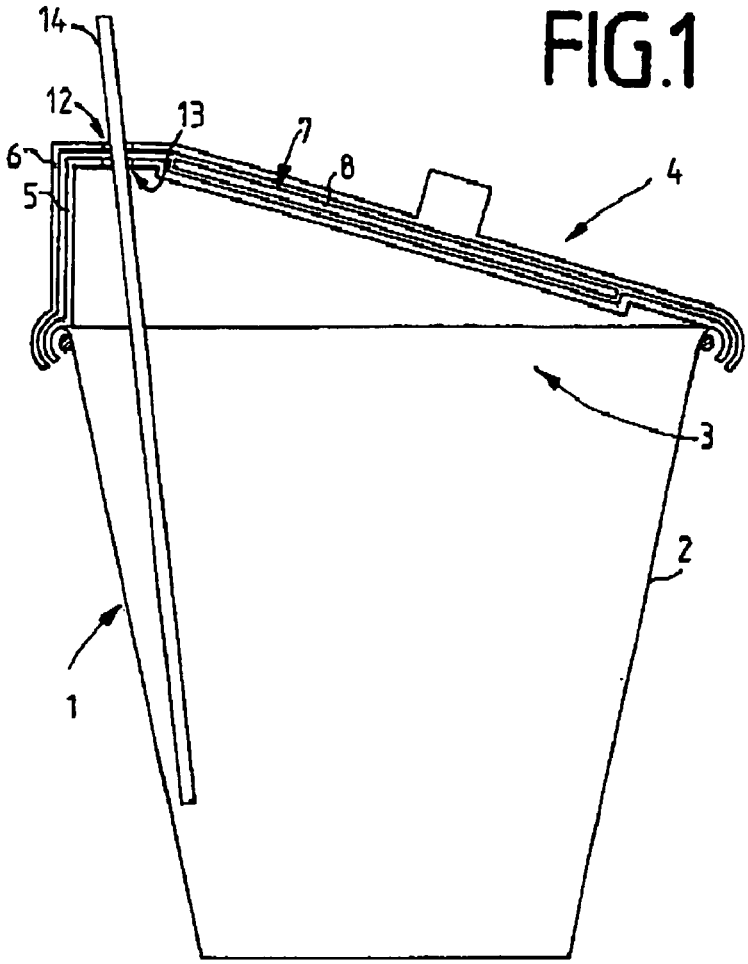

The invention relates to a container comprising a cup-type compartment having an opening and comprising a cover to be placed on said opening, said cover having an inner component and an outer component detachably connected to said inner component, between said inner component and said outer component connected to the inner component a cavity being formed for receiving one or more objects, said cavity comprising two main surfaces being parallel to one another. The invention further relates to a cover for such a container.

BACKGROUND OF THE INVENTION AND PRIOR ART

In particular in the so-called fast food sector, disposable containers are used for selling beverages. Since the consumers transport the containers with the beverages, such containers regularly have a cover. Thereby spilling of the beverage is substantially avoided. In particular in the case of cold drinks, the cover further has an opening for introducing a drinking straw. Thus a consuming person can take up the beverage without removing the cover.

In many sectors, such as in the fast food supply industry, so-called "value-addeds" are desirable. In the case of the containers, this comprises the addition of objects intended for generating additional buying incentives. For this purpose, such objects have to be connected in a suitable way to the container, or integrated therein.

A container of the type mentioned above is known in the art from the document U.S. Pat. No. 6,070,752. The prior art provides that a cavity being coaxial with the axis of the container is disposed in the cover, and a compact disc ("CD") is placed in said cavity. Furthermore, openings are provided in the cover, said openings being intended for introducing a drinking straw, and being in alignment with the central hole of the CD. A problem for the prior art container is that in particular in the area of the opening of the inner component, sealing measures have to be provided to prevent the beverage from entering into the cavity. A CD contaminated by beverage remainders regularly cannot be read anymore. Such sealing measures are either expensive to manufacture, or are not sufficiently tight to prevent beverages from entering into the cavity.

From the document U.S. Pat. No. 4,074,827, there is known in the art a drinking container also comprising a cavity in the cover for receiving objects, openings for a drinking straw being however provided outside the cavity. Thereby the cavity can be made sufficiently tight. It is disadvantageous, herein, that due to the geometric conditions caused on one hand by the size of the drinking cup and on the other hand by the size of the CD, CD's of usual size will not fit in the cavity.

It is common in the prior art containers that the main surfaces of the respective cavity are substantially parallel to the opening plane of the cup-type container.

TECHNICAL OBJECT OF THE INVENTION

It is the technical object of the invention to specify a container, in particular a drinking container, in the cover of which an object can be accommodated, safely protected from a splashing beverage, and said object being able to have relatively large spatial dimensions compared to the opening of the container.

DETAILS OF THE INVENTION AND PREFERRED EMBODIMENTS

For achieving the above technical object, the invention teaches that the two main surfaces of the cavity are at an angle ("$\alpha$") of $0° < \alpha < 90°$ to an opening plane formed by the opening. Main surfaces are surfaces, which are relatively large, compared to other surfaces of the cavity.

The invention is based on the finding that an opening, for instance for a drinking straw, can be arranged for relatively large objects to also be accommodated outside the cavity, if the main surfaces are inclined, and thus a surface being basically larger by the factor $1/\cos(\alpha)$ than the cross section of the opening is available for accommodating the cavity as well as the openings.

Preferably, the angle between the two main surfaces is $10° < \alpha < 50°$, more preferably $10° < \alpha < 30°$. In particular, the last-mentioned range is sufficient to provide a so-called mini CD for conventional drinking container dimensions and to have nevertheless sufficient space for an opening arranged outside the cavity.

The above geometric correlations apply in principle irrespective of the shape of the container, the shape of the opening of the container and the shape and the dimensions of the object or objects. In the case of drinking containers, the opening will however regularly be circular. The cavity will, in particular when using a CD as an object, be substantially cylindrical, and the main surfaces of the cavity will be cylinder front surfaces.

In detail it is preferred that, when the cover is placed on top of the container, the axis of the opening and the axis of the cavity are radially offset relative to one another by X=1 to 20 mm, in particular 3 to 10 mm, and are at an angle a relative to one another. This in particular permits the inner component and the outer component each to comprise an aligned drinking straw opening for introducing a drinking straw into the compartment provided with the cover, the drinking straw openings being arranged outside the cavity. The drinking straw openings are arranged for instance in a section of the cover being in an axial direction of the container farthest away from the opening of the container. Thereby measures for sealing the drinking straw opening against an introduced drinking straw can be achieved in a particularly simple way, since the probability of a very strong splashing of the beverage is rather low. It is however also possible that the drinking straw openings are arranged in a section of the cover being in an axial direction of the compartment closest to the opening.

In principle, a disk-type object placed in the cavity may be arbitrary. The term disk-type object is an object the opposite main surfaces of which are at least 10 times the other surfaces. Preferably, the disk-type object is a data carrier, such as a disk, CD, DVD etc., in particular a round or shaped CD. Shaped CD's do not have a circular periphery, compared to round CD's. For instance, two opposite segments of a circle may be cut off. Preferably, the outside diameter of the disk-type object is identical to or 1 to 5 mm smaller than the inner diameter of the cavity.

The subject matter of the invention is further a cover for a container according to the invention, wherein the cover has an inner component and an outer component detachably connected to said inner component, between said inner component and said outer component connected to the inner component a cavity being formed for receiving one or more objects, said cavity comprising two main surfaces being parallel to one another, and wherein the two main surfaces of the cavity are at an angle of $0°<\alpha<90°$ to a closing plane of the cover. The term closing plane corresponds to the opening plane of the cup-type compartment. Besides, the above explanations apply in an analogous manner.

Whereas the above embodiments relate to drinking cups, it is understood that other containers may also be provided with the features of the invention. For instance, in lieu of the drinking straw openings, there may be arranged pour-out openings. Then the contents of the container may be not only a liquid, but also a solid material (capable of being poured). In lieu of the drinking straw openings, discharge openings may also be provided, through which the contents of the container may be removed by means of an eating tool, for instance a spoon or a fork. Since such a discharge opening must have a larger diameter than a drinking straw opening, the geometry of the structure representing the invention is particularly advantageous.

Containers according to the invention typically, but not necessarily are disposable products, i.e. they are thrown away after use. The compartment may in particular be made of coated paper or carton. The cover and its components typically are made of a synthetic food-compatible polymer.

Figure 2:
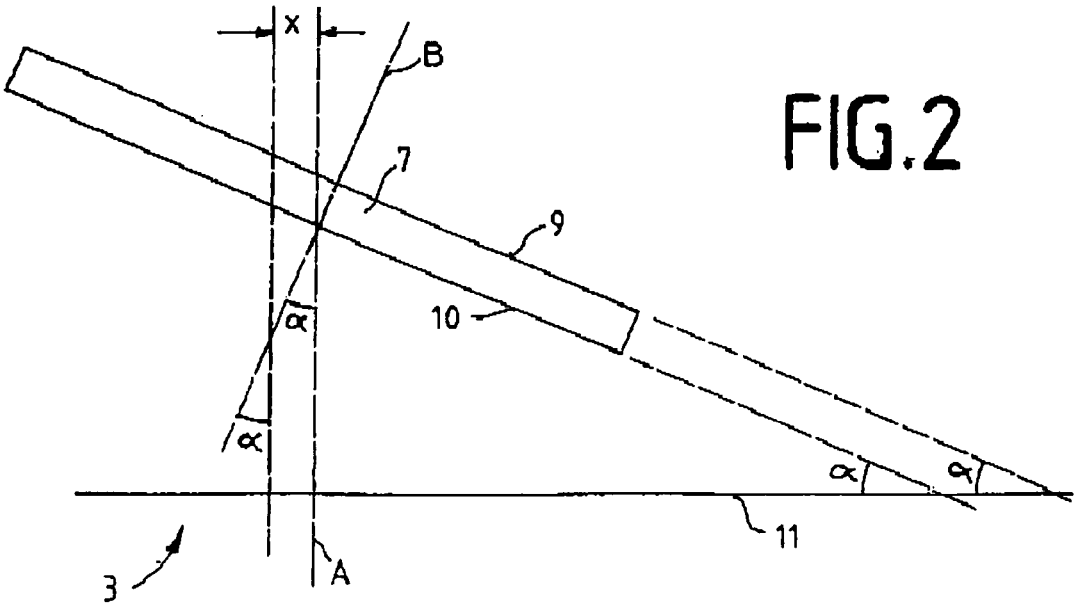
Figure 3:
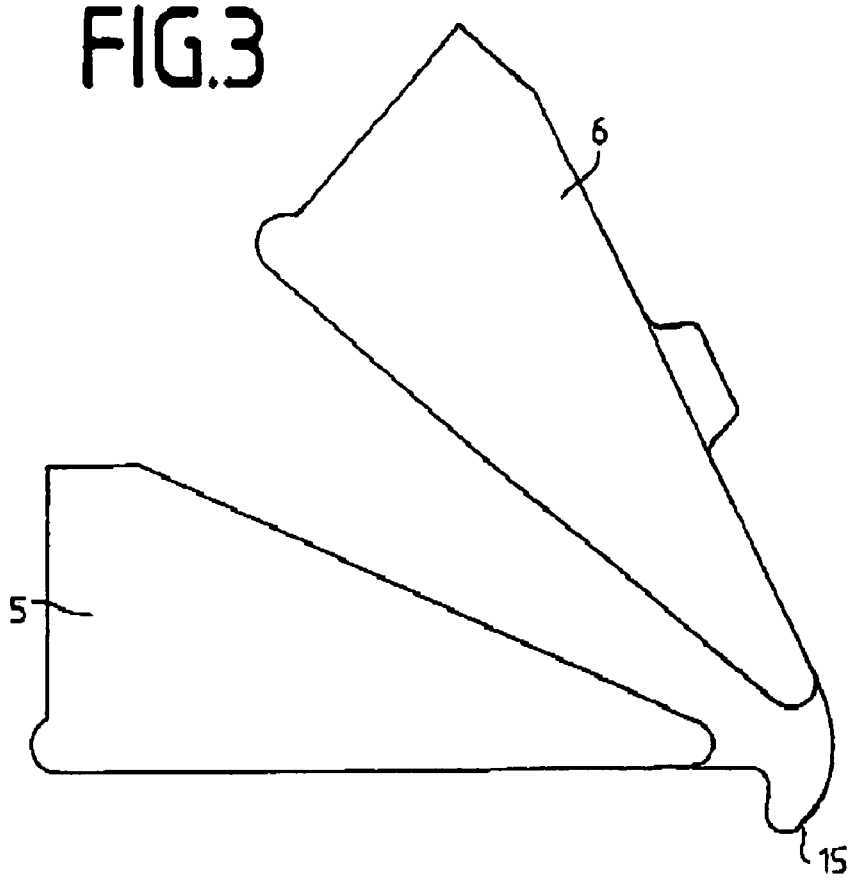
Figure 4:
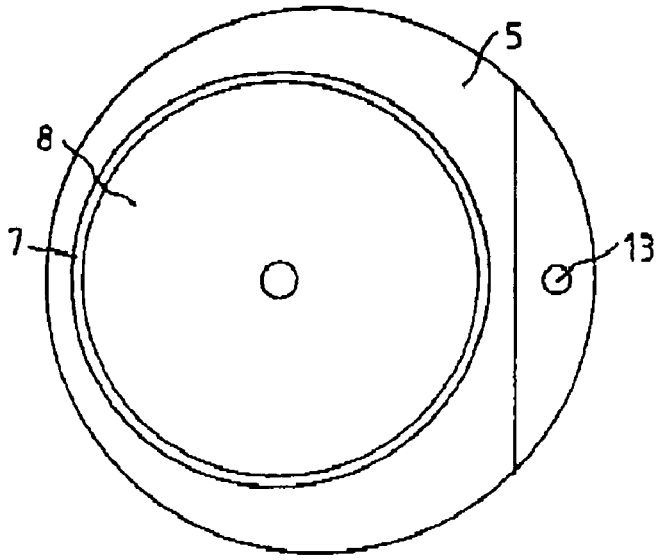

In the following, the invention will be explained in more detail, with reference to drawings representing just one embodiment. There are:

FIG. 1 a cross-sectional representation of a container according to the invention, FIG. 2 a diagrammatical representation of the geometry of the structure, FIG. 3 a diagrammatical lateral outside view of a cover according to the invention, and FIG. 4 a top view of an inner component of a cover according to the invention with inserted CD.

In FIG. 1 can be seen a container 1 with a cup-type compartment 2 having an opening 3. It is not shown that a beverage is provided in the cup-type compartment 2. A cover 4 is placed on the opening 3. The cover 4 comprises an inner component 5 and an outer component 6 detachably connected to the inner component 5. Between the inner component 5 and the outer component 6 connected to the inner component 5, a cavity 7 is formed for receiving a CD 8. The inner component 5 and the outer component 6 each comprise an aligned drinking straw opening 12, 13 for introducing a drinking straw 14 into the compartment 2 provided with the cover 4. It can be seen that the drinking straw openings 12, 13 are outside the cavity 7. In the representation can further be seen that the inserted CD 8 has an outer diameter, which is only slightly smaller than the inner diameter of the cavity 7.

In FIG. 2 are diagrammatically shown the geometric conditions of the invention. It can be seen that the cavity 7 of the cover 4 has two main planes 9, 10. These form the cylinder front surfaces of the cavity 7. Further is diagrammatically shown the opening plane 11 formed by the opening 3. The main surfaces 9, 10 are at an angle $\alpha$ to the opening plane 11. By comparison of FIGS. 1 and 2, it can further be seen that, when the cover 4 is placed on top, the axis A of the (circular) openings 3 and the axis B of the (cylindrical) cavity 7 are radially offset relative to one another by the distance X. Only thereby, as is easily recognizable in FIG. 1, the arrangement of the drinking straw opening 12, 13 outside the cavity 7 being relatively large due to the dimensions of the inserted (mini) CD is made possible.

In FIG. 3 can be seen that the inner component 5 and the outer component 6 may be connected to one another by a lug 15. This is particular advantageous with regard to a simplified mounting or a simplified assembly of the cover; it is, however, not per se necessary for the invention.

In FIG. 4 is shown a top view of an inner component 5 with inserted CD 8. From a comparison of FIGS. 1, 2 and 4, it can be seen that the surface wherein the drinking straw opening 13 is provided, is parallel to the opening plane 11 of the opening 3. In contrast thereto, the partial surface of the inner component 5 wherein the cavity 7 is embedded, is at an angle $\alpha$ to the opening plane 11.

What is claimed is:

1. A beverage container comprising a compartment having an opening and comprising a cover to be placed on said opening, said cover having an inner component and an outer component detachably connected to said inner component, a cavity being formed between a portion of said inner component and said outer component connected to the inner component for receiving at least one object, said cavity comprising two main surfaces being parallel to one another, wherein the two main surfaces of the cavity are at an angle of $0°<\alpha<90°$ to an opening plane formed by the opening, the inner component and the outer component further having a planar portion extending substantially parallel to the opening plane of the compartment opening, wherein the inner component and the outer component each further comprise an aligned drinking straw opening for introducing a drinking straw into the compartment provided with the cover, the drinking straw openings being arranged outside said cavity.

2. A container according to claim 1, wherein $\alpha$ is between 3° and 70°.

3. The container according to claim 1, wherein the opening has a circular cross-section.

4. The container according to claim 1, wherein the cavity is cylindrical and the main surfaces of the cavity are cylinder front surfaces.

5. The container according to claim 3, wherein, when the cover is placed on top, an axis A of the opening and an axis B of the cavity are radially offset relative to one another by X−1 to 20 mm and are at an angle $\alpha$ relative to one another.

6. The container according to claim 1, wherein a disk-type object, comprising a round or shaped compact disc, is placed into the cavity (7).

7. The container according to claim 6, wherein the outside diameter of the disk-type object is identical to or 0.01 to 5 mm smaller than the inner diameter of the cavity.

8. The container according to claim 1, wherein $\alpha$ is between 10° and 50°.

9. The container according to claim 1, wherein $\alpha$ is between 10° and 30°.

10. The container according to claim 5, wherein the axis A of the opening and the axis B of the cavity are radially offset relative to one another by X−3 to 10 mm.

11. The container according to claim 5, wherein the cavity is cylindrical and the main surfaces of the cavity are cylinder front surfaces.

12. The container according to claim 6, wherein the disk-type object comprises a mini-compact disc.

13. The container according to claim 2, wherein a disk-type object comprising a round or shaped compact disc is placed into the cavity.

14. The container according to claim 13, wherein the outside diameter of the disk-type object is identical to or 0.01 to 5 mm smaller than the inner diameter of the cavity.

15. The container according to claim 3, wherein the cavity is cylindrical and the main surfaces of the cavity are cylinder front surfaces.

16. The container of claim 6, wherein the cavity is cylindrical and the main surfaces of the cavity are cylinder front surfaces.

* * * * *